US006183947B1

(12) United States Patent
Ito

(10) Patent No.: US 6,183,947 B1
(45) Date of Patent: Feb. 6, 2001

(54) PREPARATION METHOD OF ORGANIC SILVER SALT DISPERSION AND THERMALLY PROCESSABLE PHOTOSENSITIVE MATERIAL

(75) Inventor: Satoshi Ito, Hino (JP)

(73) Assignee: Konica Corporation (JP)

( * ) Notice: Under 35 U.S.C. 154(b), the term of this patent shall be extended for 0 days.

(21) Appl. No.: 09/407,493

(22) Filed: Sep. 28, 1999

(30) Foreign Application Priority Data

Nov. 9, 1998 (JP) ..... 10-317719

(51) Int. Cl.[7] ..... G03C 1/498
(52) U.S. Cl. ..... 430/619; 430/617; 430/620
(58) Field of Search ..... 430/617, 619, 430/620

(56) References Cited

U.S. PATENT DOCUMENTS 3,839,049 * 10/1974 Simons .

* cited by examiner

*Primary Examiner*—Thorl Chea
(74) *Attorney, Agent, or Firm*—Jordan B. Bierman; Bierman, Muserlian and Lucas

(57) ABSTRACT

A method for preparing an organic silver salt dispersion is disclosed, comprising allowing silver nitrate is added to an aqueous solution or suspension of an alkali salt of an organic acid to react to form an organic silver salt dispersion, wherein the aqueous solution or suspension of an alkali salt of an organic acid is cooled at a mean cooling rate of not less than 0.5° C./min. to a temperature of 0° C. to 55° C., and then silver nitrate is added thereto.

7 Claims, 1 Drawing Sheet

PREPARATION METHOD OF ORGANIC SILVER SALT DISPERSION AND THERMALLY PROCESSABLE PHOTOSENSITIVE MATERIAL

FIELD OF THE INVENTION

The present invention relates to a method for preparing an organic silver salt dispersion and thermally processable photosensitive materials containing the organic silver salt dispersion prepared by use thereof.

BACKGROUND OF THE INVENTION

Methods for preparing an organic silver salt dispersion, which is used as a silver source in thermally processable photosensitive materials, are well known in the art, including a method of preparing organic silver salts in the concurrent presence of water and an organic solvent, as described in JP-A 49-93310, 49-94619 and 53-68702 (herein, the term, JP-A means published unexamined Japanese Patent Application); a method of preparing organic silver salts in an organic solvent, as described in JP-A 57-186745 and 47-9432, and U.S. Pat. No. 3,700,458; and a method of preparing organic silver salts in an aqueous solution, as described in JP-A 53-31611, 54-4117, 54-46709 and U.S. Pat. No. 5,434,043.

There are also known methods for incorporating silver halide into a thermally processable material to provide photosensitivity to the thermally processable material. There have been employed silver halides prepared based on a process of preparing conventional aqueous silver halide gelatin emulsions, which are advantageous in terms of easy introduction of techniques, such as control of the crystal size and crystal habit, impurity doping and chemical ripening. In cases when preparing organic silver salts concurrently in the presence of an organic solvent or in an organic solvent solution, however, it is difficult to allow the silver halide, which has been made water-miscible through gelatin, to be homogeneously dispersed in the organic silver salt dispersion, making it hard to achieve desired photographic characteristics, such as maximum density and sensitivity. Accordingly, in general, silver halide is added at the stage of preparing an organic silver salt in an aqueous solution. Thus, it is advantageous to prepare an organic silver salt dispersion in an aqueous solution.

In the process of preparing an organic silver salt dispersion in an aqueous solution, a fatty acid is dissolved in water at a temperature of higher than its melting point to form a sodium salt, then, after the temperature is lowered, a silver halide emulsion is added and silver nitrate is further added thereto to form an organic silver salt dispersion. Lowering the temperature before adding silver nitrate results in a rapid increase in solution viscosity and addition of silver nitrate also increases the viscosity. In cases when the solution was not uniformly stirred at a high speed, the organic silver salt was non-uniformly formed so that monodispersed fine organic silver salts were not obtained, a thermally processable material prepared by use thereof resulting in problems in performance, such as high fogging levels. It has therefore been desired to solve the problems described above.

SUMMARY OF THE INVENTION

Accordingly, an object of the present invention is to provide a method for preparing an organic silver salt dispersion in which organic silver salts are uniformly dispersed, and a thermally processable photosensitive material containing the organic silver salt dispersion, exhibiting superior photographic performance including enhanced sensitivity and low fogging, and improved image storage stability.

The object of the present invention is achieved by the following constitution:

1. a method for preparing an organic silver salt dispersion comprising the steps of:

(a) dissolving an organic acid in water at a temperature of 60 to 90° C., (b) adding thereto an alkali to form an aqueous solution or suspension containing an alkali salt of the organic acid, (c) cooling the aqueous solution or suspension to a temperature of 0 to 55° C., and then (d) adding silver nitrate to the aqueous solution or suspension to form an organic silver salt dispersion, wherein in step (c), the aqueous solution or suspension is cooled at a mean cooling rate of not less than 0.5° C./min; and 2. a thermally processable photosensitive material comprising a support having thereon an organic silver salt, a photosensitive silver halide, a reducing agent and a binder, wherein said organic silver salt is the organic silver salt dispersion prepared by the method described above.

Explanation of numerals

1 Reaction apparatus main body

2 Anchor mixer

3 Disper mixer

4 Disper mixer

5 Silver nitrate-introducing pipe

6 Homomixer

7 Stirring blade

8 Fixed ring

9 Bearing

10 Flowing direction of dispersion

11 Jacket

12 Motor

DETAILED DESCRIPTION OF THE INVENTION

Figure 1:
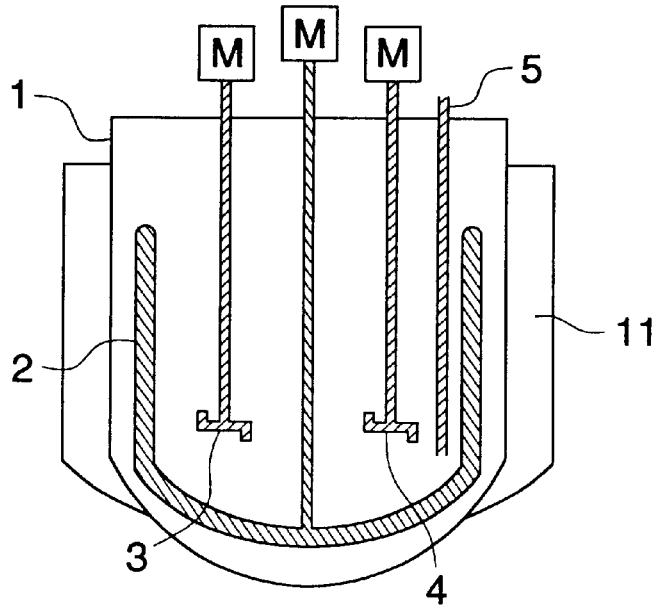
FIGS. 1 and 2 illustrate sectional view of a reaction used in the preparation method according to the invention.

In general, to prepare an aqueous solution or suspension of an alkali salt of an organic acid, the organic acid is dissolved in water at a temperature higher than the melting point of the organic acid (e.g., 60 to 90° C.) and subsequently, an alkali is added thereto to form an alkali salt thereof. Examples of the alkali used in the invention include alkali metal hydroxides and alkali metal carbonates. Specifically, alkali metal hydroxides are preferably used.

In cases when photosensitive silver halide or silver nitrate was further added thereto at a high enough temperature (i.e., 60° C. to 90° C.) to form an organic silver salt dispersion, thermal-fogging tended to occur so that it was necessary to cool the aqueous organic acid alkali salt solution or suspension, which had been maintained at a high temperature, to a temperature of 0° C. to 55° C. In such a case, the viscosity of the aqueous solution or suspension rapidly increased. As a result, it was hard to conduct sufficient stirring in the subsequent preparation of an organic silver salt dispersion with adding silver halide and silver nitrate, making it difficult to obtain an organic silver salt dispersion at superior dispersing state.

However, it was found that no abrupt rise of viscosity occurs when, prior to addition of silver nitrate, an aqueous solution or suspension of an alkali salt of an organic acid is cooled to a temperature range of 0° C. to 55° C. at a mean cooling rate of not less than 0.5° C./min. Although the details why the application of a specific mean cooling rate prevents an abrupt rise of the viscosity, is not clear, it is presumed that formation of secondary aggregates of the organic acid alkali salt is prevented when cooled at the rate described above.

The mean cooling rate refers to a value of the difference in temperature between before start of cooling and after completion of cooling, divided by the time taken for cooling, as defined below:

Mean cooling rate=(Temperature before cooling minus temperature after cooling)/ Cooling time The mean cooling rate is preferably 1° C./min. to 100° C./min.. more preferably 1.5° C./min. to 50° C./min., and still more preferably 2° C./min. to 10° C./min.

Various methods are applicable as means for cooling in the invention. Examples thereof include a cooling method employing thermal conduction from the side or bottom of a reaction vessel containing an aqueous solution or suspension of an organic acid alkali salt, as well as a cooling method by conventional heat-exchangers such as coil type heat exchanger, double pipe type heat exchanger and multiple pipe type heat exchanger.

The temperature of the aqueous solution or suspension of an organic acid alkali salt at the time of adding silver nitrate is preferably 0° to 55° C., more preferably 10 to 40° C., and still more preferably 20 to 35° C.

In the preparation method of organic silver salt dispersions according to the invention, various stirring means can be used in a reaction apparatus and a high speed stirring machine having a shearing force is preferably employed. Further, to enhance mixing efficiency, a stirrer rotating along the inner wall or bottom of a reaction apparatus may be used in combination with the high speed stirring machine described above.

Figure 2:
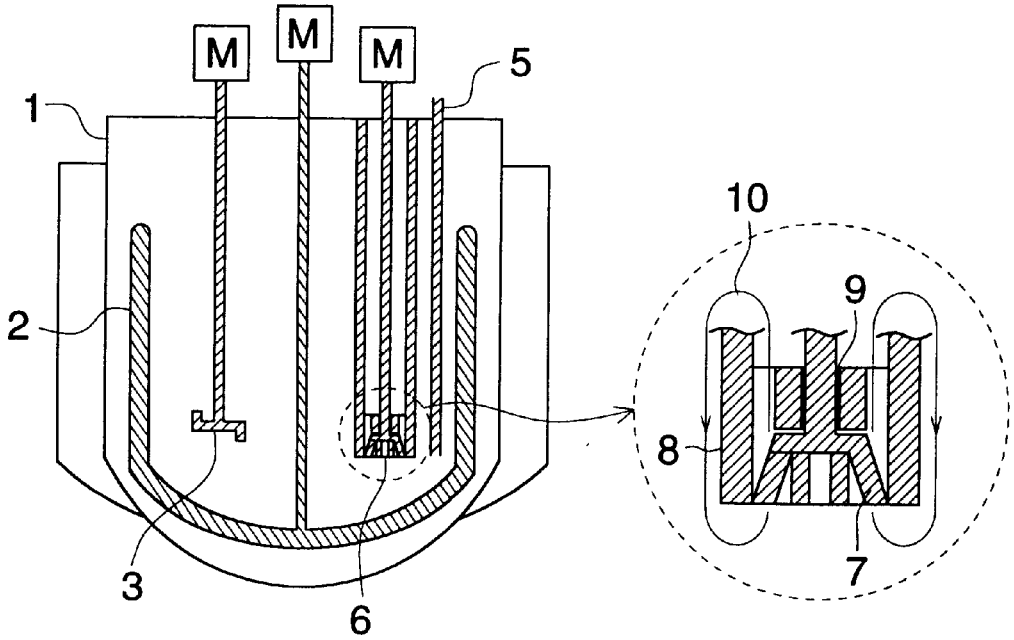

In FIGS. 1 and 2, anchor mixer 2 is the stirrer rotating along the inner wall or bottom of a reaction apparatus main body 1 and disper mixers 3 and 4 are the high speed stirring machine. In FIG. 2, disper mixer 3 and homo-mixer 6 are each high speed stirring machines.

At least one high speed stirring machine is to be provided in the reaction apparatus used in the invention, and two or more high speed stirring machines be preferably employed.

In cases when two high speed stirring machines are concurrently employed, to obtain an organic silver salt dispersion superior in dispersion uniformity, it is preferred that the high speed stirring members reversely rotate.

Employed as the high speed stirring machine in the invention is preferably a high speed rotating centrifugal radiation type stirring machine (disper mixer 9 or a high speed rotation shearing type stirring machine (homomixer). The high speed rotating centrifugal radiation type stirring machine (also called a disper type stirrer) is a device in which a disc-shaped impeller with circular saw-like edges which are bent alternately up and down, is allowed to rotate enough to cause a vortex to catch up powder into liquid and pulverize powdery aggregates through cutting action of the peripheral edges.

The high speed rotation shearing type stirring machine (also called a homomixer type stirrer) is a device comprised of a combination of a rotatable high speed stirring blade 7 and a fixed ring (stator) provided near the periphery of the stirring blade (as shown in FIG. 2), in which pulverization is carried out employing strong shearing effects or bombarding force produced in the minimal spacing between the stirring blade and the fixed ring.

The circulating speed of the disper mixer or the homomixer is preferably 1 to 100 m/sec, more preferably 1 to 100 m/sec., and still more preferably 1 to 30 m/sec. The circulating speed of the anchor mixer is preferably 0.1 to 10 m/sec, more preferably 0.1 to 5 m/sec., and still more preferably 0.1 to 3 m/sec.

Examples of the reaction apparatus shown in FIGS. 1 and 2 include T.K. Combimix (available from TOKUSHUKIKAKOGYO Co. Ltd.), Hybridmixer (available from SATAKE KAGAKUKIKAIKOGYO Co. Ltd.), vacuum emulsifying stirrer (available from MIZUHO KOGYO Co. Ltd.) and vacuum emulsifying disperser FRIMIX (available from SHINKO PANTEX Co. Ltd.).

In the preparation method of organic silver salt dispersions according to the invention, silver nitrate may be added onto the surface or into the interior of the aqueous organic acid alkali salt solution or suspension. To enhance the dispersity of organic silver salts, addition into the interior is preferred and addition into portions near the high speed stirring machine in the reaction mixture solution is more preferred.

Silver nitrate is added preferably within 60 min. (more preferably 30 min., and still more preferably 10 min.) after completion of cooling the aqueous organic acid alkali salt solution or suspension.

Organic silver salts employed in the present invention are reducible silver sources and preferred are organic acids and silver salts of hetero-organic acids having a reducible silver ion source, specifically, long chain (having from 10 to 30 carbon atoms, and preferably from 15 to 25 carbon atoms) aliphatic carboxylic acids and nitrogen-containing heterocyclic ring carboxylic acid. Organic or inorganic silver salt complexes are also useful in which the ligand has a total stability constant for silver ion of 4.0 to 10.0. Examples of preferred silver salts are described in Research Disclosure, Items 17029 and 29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

A dispersions of an aqueous organic silver salt used in the invention can be obtained by mixing silver nitrate and an alkali metal salt of an organic acid, and specifically, it is preferred to prepare the dispersion in such a manner that silver halide is added to the alkali metal salt of the organic acid and then silver nitrate is added thereto. For example, to an organic acid is added an alkali metal hydroxide (e.g., sodium hydroxide, potassium hydroxide, etc.) to form an alkali meat salt soap of the organic acid (e.g., sodium behenate, sodium arachidinate, etc.), thereafter, silver halide is added and then, silver nitrate is further added and subjected to mixing to prepare an aqueous organic silver salt dispersion. Alternatively, the organic acid alkali metal salt, silver nitrate and silver halide may be simultaneously added by the controlled triple jet addition to obtain an aqueous organic silver salt dispersion. Specifically, the preparation of an aqueous organic silver salt dispersion by the controlled triple jet addition is preferred in terms of simplicity of the manufacturing process. Furthermore, the preparation method of an aqueous organic silver salt dispersion by the controlled triple jet addition is preferred also in terms of preparing a thermal processable photosensitive material with enhanced sensitivity.

Silver halide grains of photosensitive silver halide in the present invention work as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40%; more preferably less than 30%, and most preferably from 0.1 to 20%.

Monodispersibility=(standard deviation of grain diameter)/(average grain diameter)×100(%)

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel Co., 1967), G. F. Duff in, "Photographic Emulsion Chemistry" (published by The Focal Press, 1966), V. L. Zelikman et al., "Making and Coating Photographic Emulsion" (published by The Focal Press, 1964), etc.

Generally, the content of silver halide in organic silver salt is preferably between 0.75 and 30% by weight, based on the organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au.

These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred example of M is rhodium (Rh), ruthenium (Ru), rhenium (Re), iridium (Ir) or osmium (Os).

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)\ (H_2O)Cl_4]^-$
10: $[RhCl_5(H_2O)]^{2-}$
11: $[Re(NO)Cl_5]^{2-}$
12: $[Re(NO)CN_5]^{2-}$
13: $[Re\ (NO)ClCN_4]^{2-}$
14: $[Rh(NO)_2Cl_4]^-$
15: $[Rh(NO)\ (H_2O)Cl_4]^-$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^-$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The photosensitive silver halide grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A No. 7-128768 is usable. Examples of useful tellurium sensitizers include diacyltellurides, bis(oxycarbonyl)tellurides, bis(carbamoyl) tellurides, bis(oxycarbonyl)ditellurides, bis(carbamoyl) ditellurides, compounds containing P═Te bond, tellurocarboxylic acids, Te-organictellurocarboxylic acid esters, di(poly)tellurides, tellurides, tellurols, telluroacetals, tellurosulfonates, compounds containing P-Te bond, Te containing heterocyclic ring compounds, tellurocarbonyl compounds, inorganic tellurium compounds and colloidal tellurium, etc. Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061.

Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion of which pH and pAg are kept to not less than 7 and not more than 8.3 respectively. Furthermore, the reduction sensitization can be carried out by introducing a single addition part of silver ion during the grains being formed.

Reducing agents are preferably incorporated into the thermally processable photosensitive material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below:

Formula (A)

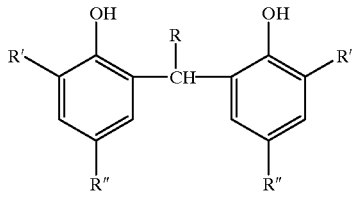

wherein R represents a hydrogen atom or an alkyl group having from 1 to 10 carbon atoms (for example, —$C_4H_9$, 2,4,4-trimethylpentyl), and R' and R'' each represents an alkyl group having from 1 to 5 carbon atoms (for example, methyl, ethyl, t-butyl).

Exemplary examples of the compounds represented by the formula (A) are shown below.

A-1

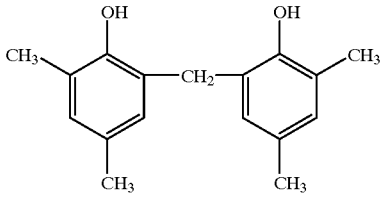

A-2

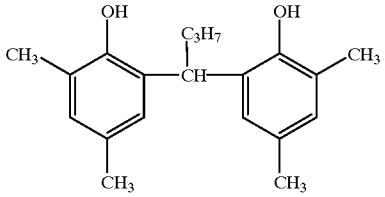

A-3

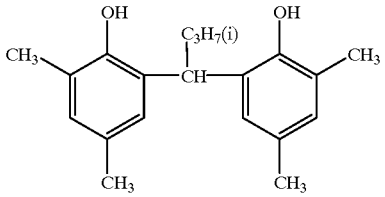

A-4

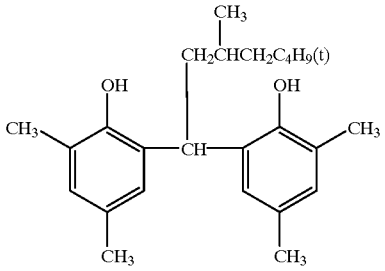

A-5

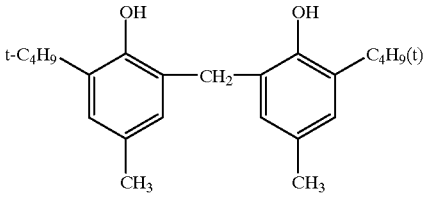

A-6

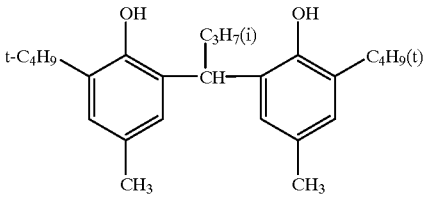

-continued

A-7

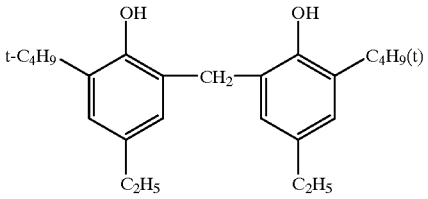

The used amount of reducing agents represented by the above-mentioned general formula (A) is preferably between $1\times10^{-2}$ and 10 moles, and is more preferably between $1\times10^{-2}$ and 1.5 moles per mole of silver.

Antifoggants may be incorporated into the thermally processable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] through [0036] of JP-A No. 9-288328. Further, as another examples of suitable antifoggants, employed preferably are compounds described in paragraph numbers [0062] and [0063] of JP-A No. 9-90550. Furthermore, other suitable antifoggants are disclosed in U.S. Pat. No. 5,028,523, and U.K. Patent Application Nos. 92221383. No. 4, 9300147. No. 7, and 9311790. No. 1.

Image toning agents are preferably incorporated into the thermally processable photosensitive material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethylsulfonyl)benzothiazole; merocyanine dyes (for example, 3-ethyl- 5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the thermally processable photosensitive material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A Nos. 9-34078, 9-54409 and 9-80679 are preferably employed.

In the present invention, to restrain or accelerate development for the purpose of controlling the development, to enhance the spectral sensitive efficiency, or to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable aromatic heterocyclic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These aromatic heterocyclic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted aromatic heterocyclic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 10 per cent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present include those in which a matting agent is previously dispersed into a coating composition and is then coated, and prior to the completion of drying, a matting agent is sprayed. When a plurality of matting agents are added, both methods may be employed in combination.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

Binders suitable for the thermally processable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinylpyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic. In the present invention, the amount of the binder in a photosensitive layer is preferably between 1.5 and 6 g/m$^2$, and is more preferably between 1.7 and 5 g/m$^2$.

Supports employed in the present invention are preferably, in order to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndioctatic structure. The thickness of the support is between about 50 and about 300 $\mu$m, and is preferably between 70 and 180 $\mu$m. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by not less than 35° C. and more preferably by at least 40° C. However, when the supports are heated at a temperature higher than the melting point, no advantages of the present invention are obtained.

Plastics employed in the present invention are described below. PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content. SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed.

The thermally developable photosensitive material according to the invention, to which the present invention is applied, is subjected to formation of photographic images employing thermal development processing and preferably comprises a reducible silver source (organic silver salt), a photosensitive silver halide with an catalytically active amount, a hydrazine derivative, a reducing agent and, if desired, an image color control agent, to adjust silver tone, which are generally dispersed into a (organic) binder matrix. The thermally developable photosensitive material according to the invention is stable at normal temperatures and is developed, after exposure, when heated (for example, to 80 to 140° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable photosensitive material according to the invention comprises a support having thereon at least one photosensitive layer, and the photosensitive layer may only be formed on the support. Further, at least one non-photosensitive layer is preferably formed on the photosensitive layer. In order to control the amount or wavelength distribution of light transmitted through the photosensitive layer, a filter layer may be provided on the same side as the photosensitive layer, and/or an antihalation layer, that is, a backing layer on the opposite side. Dyes or pigments may also be incorporated into the photosensitive layer. As the usable dyes, those which can absorb aimed wavelength in desired wavelength region can be used, preferred are compounds described in JP-A Nos. 59-6481, 59-182436, U.S. Pat. No. 4,594,312, European Patent Publication Nos. 533,008, 652,473, JP-A Nos. 2-216140, 4-348339, 7-191432, 7-301890.

Furthermore, these non-photosensitive layers may contain the above-mentioned binder, a matting agent and a lubricant such as a polysiloxane compound, a wax and a liquid paraffin.

The photosensitive layer may be composed of a plurality of layers. Furthermore, for gradation adjustment, in terms of sensitivity, layers may be constituted in such a manner as a fast layer/slow layer or a slow layer/fast layer.

Details of the thermally developable photosensitive materials are disclosed, as described above, in, for example, in U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969), etc. Of these, the thermally developable photosensitive material used in the invention is characterized in that they are thermally developed at temperature of 80 to 140° C. so as to obtain images without fixation, so that the silver halide and the organic silver salt in an unexposed portion are not removed and remain in the photosensitive materials.

In the present invention, it is preferred that optical transmission density of the photosensitive material including a support at 400 nm after thermally developed is preferably not more than 0.2, more preferably 0.02 to 0.2. With the optical transmission density of less than 0.02, sensitivity is too low to meet a practical use.

EXAMPLES

The present invention will be further explained based on examples, but embodiments of the present invention are not limited to these examples.

Example 1

Preparation of silver halide emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and $1\times10^{-4}$ mol/mol Ag of $K_2Ir(NO)Cl_5$ and an equimolar aqueous solution containing potassium bromide and potassium iodide in a molar ratio of 98 to 2 were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively. Then, sodium thiosulfate and chloroauric acid were added and ripening was carried out to obtain silver halide emulsion A.

Preparation of fatty acid sodium salt B1

Using Combimix type SL-10, produced by TOKUSHUKIKAKOGYO Co. Ltd. (as illustrated in FIG. 1), the following procedure was conducted. In the reaction vessel of the Combimix type SL-10, 212.0 g of behenic acid, 29.2 g of arachidinic acid and 8.85 g of stearic acid were dissolved in 4750 ml of water at 90° C., while anchor mixer 2 was operated at a rotation speed of 100 rpm, and disper mixers 3 and 4 each were operated at 1,500 rpm in the same direction. Subsequently, 748.5 ml of an aqueous 1.0M sodium hydroxide solution was added thereto. After adding 6.9 ml of concentrated nitric acid, the reaction mixture was cooled to 30° C. over a period of 10 min. (i.e., mean cooling rate of 6.0° C./min.) by flowing cooling water into jacket 11 of the main body 1 of the reaction apparatus to obtain a fatty acid sodium salt solution B1.

Preparation of fatty acid sodium salt B2

Aqueous fatty acid sodium salt solution B2 was prepared in the same manner as B1, except that the reaction mixture was cooled to 30° C. over 30 min.

Preparation of fatty acid sodium salt B3

Aqueous fatty acid sodium salt solution B3 was prepared in the same manner as B1, except that the reaction mixture was cooled to 30° C. over 60 min.

Preparation of fatty acid sodium salt B4

Aqueous fatty acid sodium salt solution B4 was prepared in the same manner as B1, except that the reaction mixture was cooled to 30° C. over 120 min.

Preparation of fatty acid sodium salt B5

Aqueous fatty acid sodium salt solution B5 was prepared in the same manner as B1, except that the reaction mixture was cooled to 30° C. over 150 min.

Preparation of fatty acid sodium salt B6

Aqueous fatty acid sodium salt solution B6 was prepared in the same manner as B1, except that the reaction mixture was cooled to 55° C. over 90 min.

Preparation of organic silver salt dispersion C1

Silver halide emulsion A of 38.1 g and 450 ml of water were added to aqueous fatty acid sodium salt solution B1 maintained at 30° C., while anchor mixer 2 was operated at a rotation speed of 120 rpm and disper mixers 3 and 4 was operated at 2,500 rpm. Then, after setting the rotation speed of anchor mixer 2 at 0 rpm and disper mixers 3 and 4 at 5,000 rpm, 747 ml of 1M silver nitrate solution was added, over a period of 2 min., to the vicinity of the disper mixer 3, provided that the silver nitrate solution was added at 10 min. or earlier after completion of cooling the fatty acid sodium salt solution. After varying again the rotation speed of the disper mixers 3 and 4 to 4,500 rpm, stirring further continued for 10 min. to obtain an organic silver salt dispersion. Thereafter, the resulting organic silver salt dispersion was transferred to a vessel with a volume of 30 lit., water was added with stirring, the mixture was allowed to stand and the silver salt dispersion was separated by floatation. After flotation separation, the lower water layer was removed to remove aqueous soluble salts. Then, water was further removed by a centrifugal dehydrator and the residue was dried at 40° C. over a period of 72 hrs. to obtain a powdery organic silver salt dispersion.

Preparation of organic silver salt dispersion C2

Organic silver salt dispersion C2 was prepared in the same manner as C1, except that fatty acid sodium salt solution B1 was replaced by B2.

Preparation of organic silver salt dispersion C3

Organic silver salt dispersion C3 was prepared in the same manner as C1, except that fatty acid sodium salt solution B1 was replaced by B3.

Preparation of organic silver salt dispersion C4

Organic silver salt dispersion C4 was prepared in the same manner as C1, except that fatty acid sodium salt solution B1 was replaced by B4.

Preparation of organic silver salt dispersion C5

Preparation of organic silver salt dispersion C5 was attempted in the same manner as C1, except that fatty acid sodium salt solution B1 was replaced by B5. However, the viscosity of the reaction mixture solution was abruptly raised to be solidified. As a result, silver salt dispersion B5 was not obtained.

Preparation of organic silver salt dispersion C6

Organic silver salt dispersion C6 was prepared in the same manner as C1, except that fatty acid sodium salt solution B1 was replaced by B6.

Evaluation of organic silver salt dispersion

Measurement of grain size

Each of dried powdery organic silver salt dispersions was observed by a transmission electronmicroscope and the grain size of 1,000 grains were measured at random to determine the mean major axis diameter and the mean minor axis diameter.

Measurement of dispersity

Homogeneity of the grain diameter (i.e., major axis diameter) distribution of each dispersion was determined, based on the following formula:

$$\text{Monodispersity}=(\text{Standard deviation of grain diameter})/(\text{mean grain diameter})\times100$$

The mean major axis diameter, the mean minor axis diameter and the monodispersity of each organic silver salt dispersion were shown in Table 1. In addition, the viscosity of the fatty acid sodium salt solution was also shown. Using type B viscometer (available from TOKYOKEIKI Co. Ltd.) and Nos. 1 to 4 rotor at 6 to 60 rpm and a temperature of 30° C., the viscosity was measured within 30 min. after completion of cooling each of fatty acid sodium salt solutions, provided that solution C6 was measured at 55° C.

TABLE 1

| Silver salt dispersion | Viscosity of fatty acid sodium salt solution (cp) | Mean major axis diameter (μm) | Mean minor axis diameter (μm) | Mono-dispersity (%) | Mean cooling rate (° C./min.) | Remark |
|---|---|---|---|---|---|---|
| C1 | 2.00 | 0.68 | 0.03 | 11.00 | 6 | Inv. |
| C2 | 5.00 | 0.70 | 0.03 | 12.00 | 2 | Inv. |
| C3 | 10.00 | 0.80 | 0.04 | 14.00 | 1 | Inv. |
| C4 | 100.00 | 1.10 | 0.05 | 16.00 | 0.5 | Inv. |
| C5 | Non-measurable | — | — | — | 0.4 | Comp. |
| C6 | 1000.0 | 1.80 | 0.15 | 38.00 | 0.39 | Comp. |

As apparent from Table 1, organic silver salt dispersions prepared according to the present invention exhibited a smaller mean diameter and enhanced monodispersity.

Example 2

Preparation of photosensitive emulsion E1

Dried organic silver salt dispersion C1 of 125 g, 3.6 g of polyvinyl butyral (average molecular weight of 4,000) and 363 g of methyl ethyl ketone were mixed with stirring and dispersed at 4,000 psi to obtain photosensitive emulsion E1.

Preparation of photosensitive emulsion E2

Photosensitive emulsion E2 was prepared in the same manner as E1, except that organic silver salt dispersion C1 was replaced by C2.

Preparation of photosensitive emulsion E3

Photosensitive emulsion E3 was prepared in the same manner as E1, except that organic silver salt dispersion C1 was replaced by C3.

Preparation of photosensitive emulsion E4

Photosensitive emulsion E4 was prepared in the same manner as E1, except that organic silver salt dispersion C1 was replaced by C4.

Preparation of photosensitive emulsion E6

Photosensitive emulsion E6 was prepared in the same manner as E1, except that organic silver salt dispersion C1 was replaced by C6.

Preparation of a Subbed PET Photographic Support

Both surfaces of a biaxially stretched thermally fixed 100 μm PET film, available on the market, was subjected to corona discharging at 8 w/m$^2$·min. Onto the surface of one side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (with a solid portion of 30%) of a copolymer consisting of | 270 g |

-continued

| | |
|---|---|
| Butyl acrylate (30 weight %<br>t-butyl acrylate (20 weight %)<br>2-Hydroxyethyl acrylate<br>(25 weight %) | |
| (C-1) | 0.6 g |
| Hexamethylene-1,6-bis (ethyleneurea) | 0.8 g |
| Water to make | 1 liter |
| Subbing Coating Composition b-1 | |
| Latex liquid (solid portion of 30%) of a copolymer consisting of<br>butyl acrylate (40 weight %)<br>styrene (20 weight %)<br>glycidyl acrylate<br>(25 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

| Upper Subbing Layer Coating Composition a-2 | |
|---|---|
| Gelatin | amount to make 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |
| Upper Subbing Layer Coating Composition b-2 | |
| (C-4) | 60 g |
| Latex solution (solid portion of 20%) comprising (C-5) as a substituent | 80 g |
| Ammonium sulfate | 0.5 g |
| (C-6) | 12 g |
| Polyethylene glycol (average molecular | 6 g |

-continued

| | |
|---|---|
| weight of 600) | |
| Water to make | 1 liter |

(C-1)

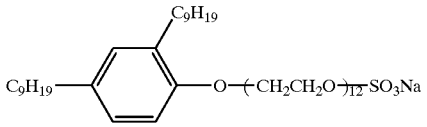

(C-2)

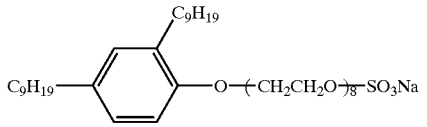

(C-3)

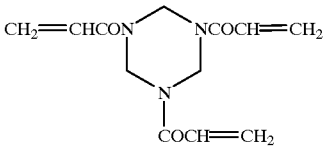

(C-4)

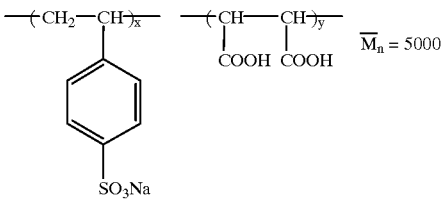

($\overline{M}_n$ = 5000)

($\overline{M}$n is a number average molecular weight)

x:y = 75:25 (weight ratio)

(C-5)

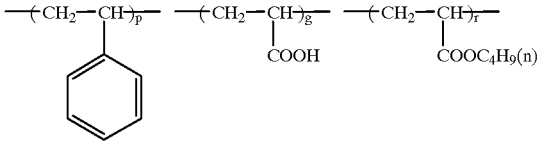

-continued

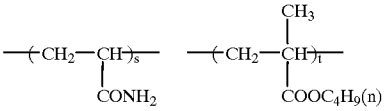

p:g:r:s:t = 40:5:10:5:40 (weight ratio)

(C-6)

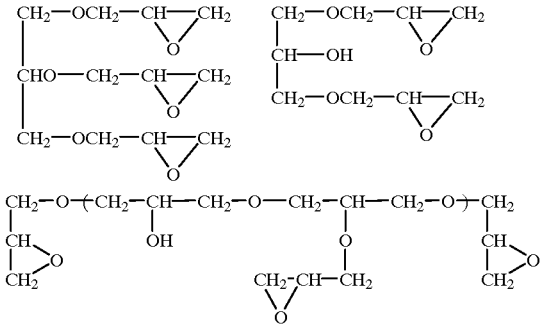

Mixture consisting of the three compounds illustrated above

Heat treatment of support

The subbed support was dried at 140° C. in the process of subbing and drying a support.

Preparation of photosensitive material

On the support were coated the following layers to prepare photosensitive material Sample 1. Drying was conducted over a period of 15 min. at 60° C. Samples 2, 3, 4 and 6 were prepared in the same manner as Sample 1, except that photosensitive emulsion E1 was replaced by emulsion E2, E3, E4 or E6.

Back side coating

The following composition was coated

| | |
|---|---|
| Cellulose acetate (10% methyl ethyl ketone solution) | 15 ml/m$^2$ |
| Dye-B | 7 mg/m$^2$ |
| Dye-C | 7 mg/m$^2$ |
| Matting agent, monodispersed silica having monodispersity of 15% and a mean size of 10 $\mu$m | 30 mg/m$^2$ |
| $C_9H_{19}$—$C_6H_4$—$SO_3Na$ | 10 mg/m$^2$ |

Dye-B

-continued

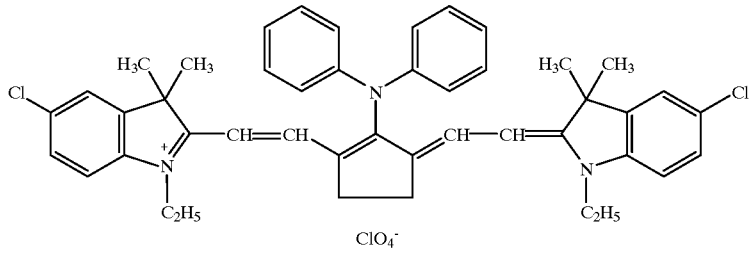

Dye-C

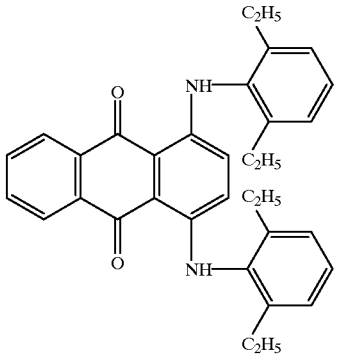

Emulsion side coating

Photosensitive layer 1

The following composition was coated so as to have silver coverage of 2.1 g/m$^2$.

| | |
|---|---|
| Photosensitive emulsion, as shown in Table 2 | 240 g |
| Sensitizing dye-1 (0.1% methanol solution) | 1.7 ml |
| Pyridinium bromide perbromide (6% methanol solution) | 3 ml |
| Calcium bromide (0.1% methanol solution) | 1.7 ml |
| Antifoggant-2 (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Tribromethylsulfoquinoline (5% methanol solution) | 17 ml |
| Reducing agent A-4 (20% methanol solution) | 29.5 ml |
| Contrast-increasing agent H (1% methanol solution) | 3 ml |

Sensitizing dye-1

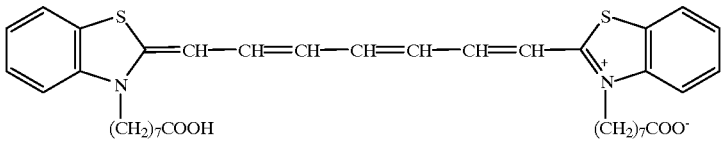

Antifoggant-2

-continued

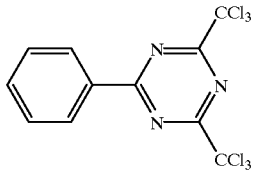

Contrast-increasing agent H

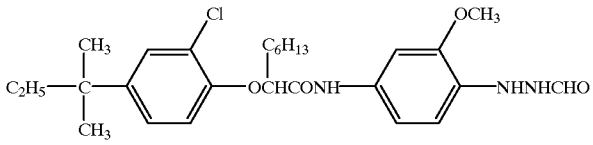

Surface protective layer

The following composition was coated on the photosensitive layer.

| | |
|---|---|
| Acetone | 35 ml/m$^2$ |
| Methyl ethyl ketone | 17 ml/m$^2$ |
| Cellulose acetate | 2.3 g/m$^2$ |
| Methanol | 7 ml/m$^2$ |
| Phthalazinone | 250 mg/m$^2$ |
| 4-Methylphthalic acid | 180 mg/m$^2$ |
| Tetrachlorophthalic acid | 150 mg/m$^2$ |
| Tetrachlorophthalic acid anhydride | 170 mg/m$^2$ |
| Matting agent, monodispersed silica having monodispersity of 10% and a mean size of 4 $\mu$m | 70 mg/m$^2$ |
| $C_9H_{19}$—$C^6H^4$—$SO_3Na$ | 10 mg/m$^2$ |

Evaluation of photosensitive material

Exposure and Processing

Thermally processable photosensitive material samples were exposed using an imager having a semiconductor laser of 810 nm and then heat-developed at 120° C. over a period of 15 sec., using an automatic processor provided with a heat drum, provided that exposure and heat development were conducted in the room maintained at 23° c. and 50% RH.

Evaluation of photographic performance

Images obtained after heat development were evaluated using a densitometer, with respect to a minimum density, Dmin and sensitivity (which is represented as reciprocal of exposure necessary to give a density of 0.1 plus Dmin). The less Dim. the better. Sensitivity was represented as a relative value, based on the sensitivity of Sample 4 being 100.

Evaluation of image lasting quality

Samples which were processed in the same manner as in the evaluation of photographic performance were in the dark room maintained at 55° C. and 55% RH over a period of 7 days and visually evaluated with respect to image tone, based on the following criteria:

5: No problem in tone,

4: Level of no problem in practical use,

3: Slightly yellowish but acceptable level,

2: Disagreeable tone and unacceptable in practical use,

1: Marked change in color and unacceptable tone

Results are shown in Table 2.

TABLE 2

| Sample | Emulsion | Silver salt dispersion | Dmin | Sensitivity | Image lasting quality | Remark |
|---|---|---|---|---|---|---|
| 1 | E1 | C1 | 0.18 | 210 | 5 | Inv. |
| 2 | E2 | C2 | 0.20 | 205 | 5 | Inv. |
| 3 | E3 | C3 | 0.21 | 203 | 5 | Inv. |
| 4 | E4 | C4 | 0.23 | 200 | 5 | Inv. |
| 6 | E6 | C6 | 0.41 | 100 | 1 | Comp. |

As apparent from Table 2, inventive samples exhibited superior results in photographic performance and image storage stability.

What is claimed is:

1. A method for preparing an organic silver salt dispersion comprising the steps of:

(a) dissolving an organic acid in water at a temperature of 60 to 90° C., (b) adding thereto an alkali to form an aqueous solution or suspension containing an alkali salt of the organic acid, (c) cooling the aqueous solution or suspension to a temperature of 0 to 55° C., and then (d) adding silver nitrate to the cooled aqueous solution or suspension to form an organic silver salt dispersion, wherein in step (c), the aqueous solution or suspension is cooled at a mean cooling rate of not less than 0.5° C./min.

2. The method of claim 1, wherein the mean cooling rate is 1° C./min. to 100° C./min.

3. The method of claim 1, wherein in step (d), a photosensitive silver halide is added to the aqueous solution or suspension prior to or concurrently with the addition of silver nitrate.

4. The method of claim 3, wherein in step (d), a photosensitive silver halide is added to the aqueous solution or suspension prior to the addition of silver nitrate.

5. The method of claim 3, wherein said silver halide comprises silver chloride, silver chlorobromide, silver iodochlorobromide, silver bromide, silver iodobromide or silver iodide.

6. The method of claim 3, wherein said silver halide is added in an amount of 0.75 to 30% by weight of the organic silver salt, based on silver.

7. A thermally processable photosensitive material comprising a support having thereon an organic silver salt, a photosensitive silver halide, a reducing agent and a binder, wherein said organic silver salt is the organic silver salt dispersion prepared by the method as claimed in claim 1.

* * * * *